United States Patent [19]

Stahlecker

[11] Patent Number: 4,761,946

[45] Date of Patent: Aug. 9, 1988

[54] ARRANGEMENT FOR THE PRESTRENGTHENING OF THREAD COMPONENTS TO BE TWISTED TOGETHER

[75] Inventor: Fritz Stahlecker, Josef—Neidhart Strasse 18, 7347 Bad Überkingen, Fed. Rep. of Germany

[73] Assignees: Fritz Stahlecker; Hans Stahlecker, both of Fed. Rep. of Germany

[21] Appl. No.: 13,789

[22] Filed: Feb. 12, 1987

[30] Foreign Application Priority Data

Mar. 4, 1986 [DE] Fed. Rep. of Germany ..... 3606932

[51] Int. Cl.[4] ..... D01H 5/28; D02G 3/26

[52] U.S. Cl. ..... 57/328; 57/204; 57/293

[58] Field of Search ..... 57/297, 294, 328–331, 57/204, 205

[56] References Cited

U.S. PATENT DOCUMENTS

| | | | |
|---|---|---|---|
| Re. 31,705 | 10/1984 | Morihashi | 57/328 X |
| 3,443,370 | 5/1969 | Walls | 57/293 |
| 3,822,543 | 7/1974 | Edagawa et al. | 57/328 X |
| 4,055,039 | 10/1977 | Movshovich et al. | 57/293 |
| 4,147,020 | 4/1979 | Oakes | 57/289 |
| 4,206,589 | 6/1980 | Markey et al. | 57/293 |
| 4,219,998 | 9/1980 | Farnhill | 57/293 |
| 4,484,436 | 11/1984 | Nakayama et al. | 57/328 |
| 4,574,579 | 3/1986 | Chao | 57/328 |
| 4,596,115 | 6/1986 | Maeda et al. | 57/289 |

FOREIGN PATENT DOCUMENTS

| | | |
|---|---|---|
| 0038143 | 10/1981 | European Pat. Off. . |
| 0070210 | 1/1983 | European Pat. Off. . |
| 0126659 | 11/1984 | European Pat. Off. . |

*Primary Examiner*—John Petrakes

*Attorney, Agent, or Firm*—Barnes & Thornburg

[57] ABSTRACT

An arrangement is provided for the prestrengthening of at least two thread components to be twisted together. It is provided that false-twist elements are arranged downstream from a drawing device in a sloped position with respect to the transport direction of the drawing device and approach one another in a V-shape so that at least a part of the deflection required for the guiding-together of the thread components takes place between the drawing device and the false-twist elements. The process for prestrengthening the two thread components is also provided.

23 Claims, 2 Drawing Sheets

ARRANGEMENT FOR THE PRESTRENGTHENING OF THREAD COMPONENTS TO BE TWISTED TOGETHER

BACKGROUND AND SUMMARY OF THE INVENTION

The invention relates to an arrangement for the prestrengthening of at least two thread components that are to be twisted together. The arrangement includes a drawing device for the thread components that are aligned in parallel to one another, false-twist elements that are connected behind the drawing device, guide elements for the guiding together of the thread components behind the false-twist elements, a device for the withdrawing of the thread components and a device for the winding of the guided-together thread components on a spool serving as a feed spool for a twisting arrangement.

In other arrangements of this type (EP-A Nos. 38 143, 70 210, 126 659), the thread components are drawn to the desired yarn size in drawing means. Subsequently, they pass through false-twist elements in which they are strengthened, without receiving a true twist, to such an extent that they can be wound up perfectly and can pass through a subsequent twisting process. By the false-twisting, the thread components are only slightly prestrengthened, without receiving a twist, so that during the subsequent twisting, no twist has to be undone in the thread components. This will result in significantly higher production speeds at reduced costs. By the guiding-together of the thread components and the joint winding-up, the advantage is achieved that the absolute firmness of the two thread components is practically doubled, so that sufficient firmness exists for the subsequent twisting process, although the individual thread component has a relatively low firmness. In known arrangements, unless the fiber components pass jointly through the same false-twisting element, the guiding-together of the fiber components takes place behind the false-twist elements. In that case, a deflection must take place in order to bridge the distance at which the fiber components are supplied out of the pertaining drawing means. These deflections behind the false-twist elements result in an increased stress to the thread component so that, particularly at these points, there is the danger of a breakage of the thread component.

An object of the invention is to construct an arrangement of the initially mentioned type in such a way that the guiding-together a converging toward one another of the thread components behind the false-twist elements is connected with a strain that is as low as possible so that the danger of a breakage of the thread components is reduced.

This object is achieved by arranging the false-twist elements in an inclined position with respect to the transport direction of the drawing device such that the thread components converge toward one another so that at least a part of the deflection required for the guiding-together on converging of the thread components toward one another takes place between the drawing device and the false-twist elements.

By this arrangement, the deflection of the thread components is displaced to a larger part into the area between the drawing device and the false-twist elements so that the angle of deflection behind the false-twist elements can be correspondingly smaller. In this case, the false-twist elements provide the thread components with a false twist that is effective upstream and that acts as a protective twist for the thread components approaching the false-twist elements. Therefore, the thread components in this area have a relatively high firmness and are not so endangered by a deflective guiding as in the area behind the false twist elements in which the false twist has already become undone, and the only prestrengthening is caused by shiftings of fibers without any twist in the thread components.

According to other advantageous features of certain preferred embodiments of the invention, it is provided that, in each case, at least one guiding element is arranged between the drawing device and the false-twist elements. These guiding elements ensure that the moving direction of the thread components in the drawing device is not disturbed. In a further advantageous development, it is provided that the guiding elements, in each case, are arranged at a distance from the pertaining drawing device that is shorter than the staple length of the fiber material of the thread components. The guiding elements, at which the deflection takes place, act as a twist brake so that the false twist is stopped essentially in the area of the guiding elements. Nevertheless, because of the stability of the fiber component chosen, sufficient stability of the thread is maintained.

According to other advantages features of certain preferred embodiments of the invention, it is provided that the guiding elements that are connected in front of the false-twist elements are aligned with respect to the false-twist elements in such a way that a straight course of the thread component exists through the false-twist elements. As a result, it is ensured that the providing of the false-twist is not hindered. For the same purpose, it is provided in a further development that the guiding elements connected behind the false-twist elements are aligned with respect to the false-twist elements in such a way that a straight course of the thread components is obtained through the thread elements.

According to other advantageous features of certain preferred embodiments of the invention, it is provided that air nozzles are provided as false-twist elements. These types of air nozzles can more easily be arranged at a slope than mechanical elements because the inclining of the mechanical false-twist elements requires a more complicated drive that is advantageously derived from a continuous driving element that drives all operating points of one machine.

According to other advantageous features of certain preferred embodiments of the invention, it is provided that each false-twist element contains two air nozzles that are connected behind one another. This development is particularly suitable for relatively wide thread components. However, it should be taken into account in this case that the air nozzles do not have the effect that is known from the air spinning process; i.e., no individual threads are to be formed that have a relatively high inherent stability that are suitable, for example, for a weaving process. The prestrengthening, in the case of a largely unchanged parallel alignment of the fibers, must only be so high that an intermediate winding for the subsequent twisting process is possible.

According to other advantageous features of certain preferred embodiments of the invention, it is provided that the false-twist elements are arranged on a joint holding part. In an advantageous further development, it is also provided in this case that the guiding elements that are connected in front of and/or behind the false-twist elements are arranged on the joint holding part of the false-twist elements. As a result, a constructionally simple structural unit is obtained that, if necessary, can be exchanged for servicing or for an adapting to other fiber materials.

Other objects, advantages and novel features of the present invention will become apparent from the following detailed description of the invention when considered in conjunction with the accompanying drawings.

DETAILED DESCRIPTION OF THE DRAWING

Figure 1:
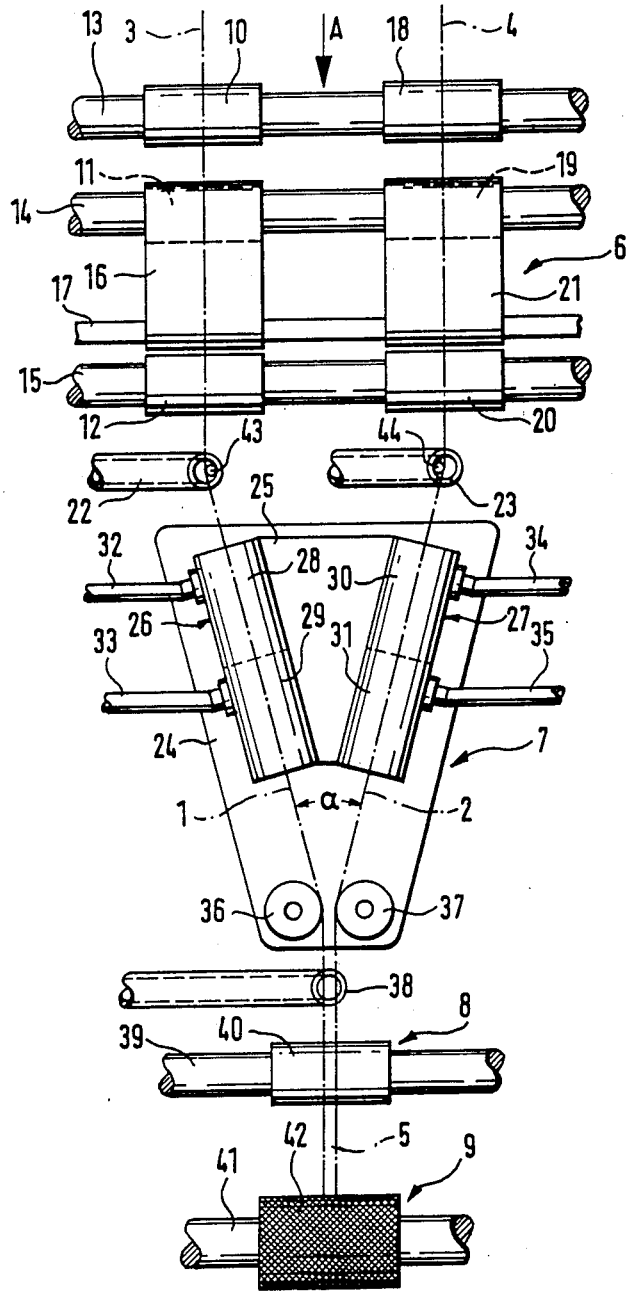
FIG. 1 is a schematic view of the invention.

In the shown arrangement, two undrawn slivers (3 and 4) are guided through a drawing device (6) through which they pass in the direction of the arrow (A), whereby they are drawn to the thread components (1, 2) drawn to the desired size. The thread components (1, 2) are guided together to converge toward one another to form an essentially untwisted double thread (5) that is withdrawn by means of a withdrawal device (9). The subsequent twisting takes place in a separate operating process on a separate arrangement. Therefore, the two thread components 1, 2 are not twisted around one another and are withdrawn side by side as discrete components as shown by separate dash-dot lines at (5).

So that a sufficient spinning stability is obtained in the thread components (1, 2) despite the absence of a true twist, a prestrengthening of the thread components (1, 2) is carried out in a false-twist arrangement (7). Behind the false-twist arrangement (7), the provided false-twist is undone. However, because of the hairiness of the thread components (1, 2), a certain residual twist remains, mainly in the shell of the thread components (1, 2), that leads to a certain prestrengthening.

In the case of a machine used in practice, a plurality of arrangements shown in the drawing are arranged next to one another that are largely equipped with drives passing through in longitudinal direction of the machine. The drawing device (6) drawing the slivers or roves, in a known way, contain three driven bottom cylinders (13, 14, 15), to which for each drawing device (6) top cylinders (10, 11, 12, 18, 19, 20) are assigned. In the main drawing zones, small guiding belts (16, 21) are arranged between the top cylinders (11, 12, 19, 20) and the bottom cylinders (14, 15). The small guiding belts (16, 21) are guided in a known way via a reversing rail (17).

The two thread components (1, 2) leave the drawing device (6) at a distance from one another and move over suction devices (22, 23). In the case of a possible thread breakage, the continuously furnished thread components (1 or 2) are sucked off by means of these suction devices (22, 23) or in addition to them, a so-called rove-stopping device may be provided that is part of the state of the art. In the area of the suction devices (22, 23), thread guiding elements or thread orientation elements (43, 44) are provided that serve as deflecting guides. In the shown embodiment, these guiding elements (43, 44) are represented as rods, which are advantageously constructed as closed guides, for example, in the form of lugs or small suction tails.

Between the drawing device (6) and the withdrawal device (8), a holding plate (24) is disposed on which the false-twist device (7) is arranged. The false-twist device (7) contains a joint component (25) that is equipped with the false-twist elements (26, 27). The false-twist elements (26, 27) are each assigned to one thread component (1 or 2). In the shown embodiment, the false-twist elements (26, 27) each contain two air nozzles (28, 29 and 30, 31) that are arranged behind one another, and are known per se as via lines (32, 33, 34, 35) are connected to a compressed air supply line that is not shown. The air nozzles (28, 29) as well as 30, 31) each rotate in the same direction.

Figure 1A:
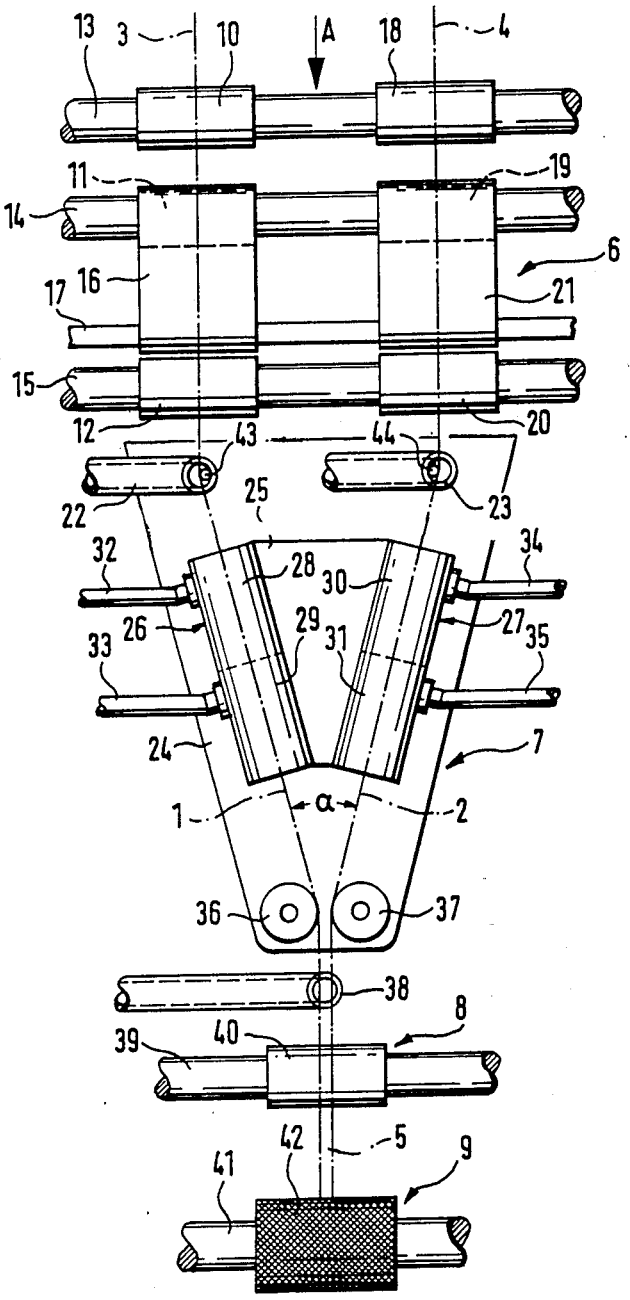
FIG. 1*a* is a schematic view of one embodiment of the guide elements.

As shown in the drawing figure, the false-twist elements (26, 27) are arranged in a V-shaped with respect to one another in such a way that the thread components (1, 2) that leave the drawing device (6) in parallel to one another, are guided to converge toward one another. Guide pulleys (36, 37) used as the guiding elements or thread orientation elements are connected behind the false-twist elements (26, 27). In the area of the guide pulleys (36, 37), the two thread components (1, 2) are guided together to form the untwisted double thread components (5). The freely rotating and, in certain embodiments, driven guide pulleys (36, 37), are equipped with guide grooves for the thread components (1, 2), in a way that is not shown in detail. The guide pulleys (36, 37) are arranged on the same holding plate (24) that carries the component (25) with the false-twist elements (26, 27). In an advantageous way, the guiding elements (43, 44) can also be arranged on this base plate (24) (FIG. 1*a*). As shown in the drawing, the guiding elements (43, 36, 44 37) assigned to one thread component (1 or 2) respectively, are arranged in such a way that the thread components (1, 2) pass through false-twist elements (26, 27), constructed as air nozzles (28, 29, 30 31), in a straight line and without deflections. As shown in the drawing, in the area of the guide pulleys (36, 37), only a relatively slight deflection is required for the thread components (1, 2) because closely adjacent mouths of the false-twist elements (26, 27) are arranged at an acute angle that preferably is smaller than 30°.

Between the guide pulleys (36, 37) and the withdrawal device (8) arranged after them, a suction device (38) is arranged by means of which, in the case of a thread breakage between the false-twist arrangement (7) and the withdrawal device (8), the torn thread components (1, 2) can be sucked off temporarily. It is therefore possible to do without the suction devices (22, 23) that are connected after the drawing device (6) under certain circumstances. In accordance with certain preferred embodiments, in the case of a breakage of only one thread component (1 or 2), it is advantageous if the other thread component is also cut by a device that is not shown so that only double threads (5) are wound onto the spool (42).

As the withdrawal device (8) at each arrangement, a continuous cylinder (39) is provided to which its own pressure roller (40) is assigned. As the windup device (9) for the double thread components (5), a windup roller (41) is used that passes through in longitudinal direction of the machine and on which rests the spool that is used for the later operating phase as a feed spool for a twisting arrangement. This spool (42) is held by a holding device in a way that is not shown.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed:

1. Apparatus for the prestrengthening of at least two thread components that are to be subsequently twisted together, comprising:

drawing means for drawing said at least two thread components and transporting said at least two thread components in a respective transport direction, said at least two thread components being spaced a first predetermined distance from one another as they exit from said drawing means, at least two false-twist means disposed downstream of said drawing means in the transport direction of the thread components for applying a false-twist, said at least two false-twist means being arranged in a sloped position with respect to the transport direction of the drawing means such that said at least two thread components are guided to converge toward one another in transport direction of said thread components through said at least two false-twist means and such that the distance between each of said at least two thread components decreases in the transport direction of said thread components through said at least two false-twist means, withdrawing means for withdrawing the at least two prestrengthened thread components separate and untwisted, and thread orientation means for guiding the at least two thread components through said arrangement, said thread orientation means including first thread component deflecting means disposed between said drawing means and said at least two false twist means and second thread component deflecting means disposed between said at least two false-twist means and said withdrawing means for deflecting said at least two thread components toward one another and for providing for the withdrawal of said at least two thread components adjacent one another, whereby said first deflecting means engage the at least two thread components at a location of optimum strength and reduce the deflection at said second deflecting means.

2. Apparatus as in claim 1, wherein the thread orientation means is aligned with the false-twist means such that a straight course of said thread components exists through the false-twist means.

3. Apparatus as in claim 1, wherein said at least two thread components include a fiber material having a predetermined staple length, said first deflecting means being arranged at a distance from the pertaining drawing means that is shorter than the staple length of the fiber material of the thread components.

4. Apparatus as in claim 1, wherein said first deflecting means deflect the at least two thread components toward one another and the second deflecting means provides for the withdrawal of said at least two thread components adjacent one another.

5. Apparatus as in claim 4, wherein said at least two thread components include a fiber material having a predetermined staple length, said first deflecting means being arranged at a distance from the pertaining drawing means that is shorter than the staple length of the fiber material of the thread components.

6. Apparatus as in claim 4, wherein said false-twist means include pneumatic false-twist means.

7. Apparatus as in claim 1, wherein said at least two false-twist means comprise a pair of false-twist means which are arranged in a V-shape in the thread component transport direction such that the distance between said thread components decreases in transport direction through said pair of false-twist means.

8. Apparatus as in claim 1, wherein the first deflecting means are aligned with the false-twist means such that a straight course of the thread components exists through the false-twist means.

9. Apparatus as in claim 1, wherein the second deflecting means are aligned with the false-twist such that a straight course of the thread components exists through the false-twist means.

10. Apparatus as in claim 1, wherein the false-twist means include pneumatic false-twist means.

11. Apparatus as in claim 10, wherein the false-twist means include a plurality of false-twist elements, each of said false-twist elements including two air nozzles connected behind one another.

12. Apparatus as in claim 11, wherein the false-twist elements are arranged on a joint holding part.

13. Apparatus as in claim 12, wherein at least one of the first deflecting means and the second deflecting means are disposed on the joint holding part.

14. Apparatus as in claim 1, wherein the false-twist means include a plurality of false-twist elements.

15. Apparatus as in claim 14, wherein the false-twist elements are arranged on a joint holding part.

16. Apparatus as in claim 15, wherein at least one of the first deflecting means and the second deflecting means are disposed on the joint holding part.

17. Process for the prestrengthening of at least two thread components that are to be subsequently twisted together, comprising:

drawing said at least two thread components through drawing means, said at least two thread components being spaced a first predetermined distance from one another as they exit said drawing means, transporting said at least two thread components in a respective transport direction through and from said drawing means, false-twisting said at least two thread components in at least two false-twist means disposed downstream of the drawing means in the transport direction of the thread components, said at least two false-twist means being arranged in a sloped position with respect to the transport direction of the drawing means such that said at least two thread components are guided to converge toward one another and such that the distance between each of said at least two thread components decreases in the transport direction of said thread components through said at least two false-twist means, withdrawing the at least two predetermined thread components separate from one another and untwisted, and guiding the at least two thread components through thread orientation means, said thread orientation means including first thread component deflecting means disposed between said drawing means and said at least two false twist means and second thread component deflecting means disposed between said at least two false-twist means and said withdrawing means for deflecting said at least two thread components toward one another and for providing for the withdrawal of said at least two thread components adjacent one another, whereby said first deflecting means engage the at least two thread components at a location of optimum strength and reduce the deflection at said second deflection means.

18. Process as in claim 17, wherein the guiding of the thread components by the thread orientation means is such that a straight course of thread components is assured through the false-twist means.

19. Process as in claim 17, wherein the guiding of the thread components upstream from the false-twist means is such that a straight course of thread components exists through the false-twist means.

20. Process as in claim 17, wherein the guiding of the thread components downstream from the false-twist means is such that a straight course of thread components exists through the false-twist means.

21. Process as in claim 17, wherein said false-twisting includes using pneumatic false-twist means.

22. Process as in claim 17, wherein said guiding of the at least two thread components includes said first deflecting means deflecting the at least two thread components toward one another and said second deflecting means providing for the withdrawal of said at least two thread components adjacent one another.

23. Process as in claim 22, wherein said false-twisting includes using pneumatic false-twist means.

* * * * *